US009607561B2

(12) United States Patent
Inada et al.

(10) Patent No.: US 9,607,561 B2
(45) Date of Patent: Mar. 28, 2017

(54) LIQUID CRYSTAL DISPLAY DEVICE AND METHOD FOR DRIVING SAME

(71) Applicant: Sharp Kabushiki Kaisha, Osaka-shi, Osaka (JP)

(72) Inventors: Ken Inada, Osaka (JP); Taketoshi Nakano, Osaka (JP); Asahi Yamato, Osaka (JP); Akizumi Fujioka, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 84 days.

(21) Appl. No.: 14/421,196

(22) PCT Filed: Jun. 21, 2013

(86) PCT No.: PCT/JP2013/067052

§ 371 (c)(1),
(2) Date: Feb. 12, 2015

(87) PCT Pub. No.: WO2014/034235

PCT Pub. Date: Mar. 6, 2014

(65) Prior Publication Data

US 2015/0243235 A1 Aug. 27, 2015

(30) Foreign Application Priority Data

Aug. 30, 2012 (JP) ..... 2012-189393

(51) Int. Cl.
*G09G 3/36* (2006.01)

(52) U.S. Cl.
CPC ..... *G09G 3/3614* (2013.01); *G09G 3/3659* (2013.01); *G09G 2310/0243* (2013.01);
(Continued)

(58) Field of Classification Search
CPC ..... G09G 3/3614; G09G 3/3659; G09G 2320/0247; G09G 2310/0243;
(Continued)

(56) References Cited

U.S. PATENT DOCUMENTS 8,013,824 B2 * 9/2011 Chu ..... G09G 3/3696 345/90
8,866,984 B2 * 10/2014 Yamazaki ..... H01L 29/12 349/43
(Continued)

FOREIGN PATENT DOCUMENTS

JP 2003-337577 A 11/2003
JP 2006-126475 A 5/2006
(Continued)

OTHER PUBLICATIONS

Official Communication issued in International Patent Application No. PCT/JP2013/067052, mailed on Aug. 6, 2013.

*Primary Examiner* — Lun-Yi Lao
*Assistant Examiner* — Kelly B Hegarty
(74) *Attorney, Agent, or Firm* — Keating & Bennett, LLP

(57) ABSTRACT

An image determination part configured to determine whether or not an image based on an input image signal is an image analogous to a polarity reversal pattern in a reversal driving scheme employed by default and to output a determination result, and a reversal pattern decision part configured to decide a reversal driving scheme based on the determination result are provided as constituent elements anterior to a liquid crystal drive unit. With regard to each unit area where the determination by the image determination part is made, the reversal pattern decision part decides the reversal driving scheme in the unit area, as a reversal driving scheme different from the reversal driving scheme employed by default, when the determination result indicates that the image based on the input image signal is the image analogous to the polarity reversal pattern in the reversal driving scheme employed by default.

9 Claims, 10 Drawing Sheets

(52) U.S. Cl.
CPC . *G09G 2310/0289* (2013.01); *G09G 2310/06* (2013.01); *G09G 2310/08* (2013.01); *G09G 2320/0223* (2013.01); *G09G 2320/0247* (2013.01); *G09G 2330/021* (2013.01)

(58) Field of Classification Search
CPC ..... G09G 2310/0289; G09G 2310/06; G09G 2320/0223; G09G 2310/08; G09G 2330/021
See application file for complete search history.

(56) References Cited

U.S. PATENT DOCUMENTS 8,928,571 B2 * 1/2015 Chen ..... G09G 3/3614 345/96
2004/0021625 A1 2/2004 Lee
2005/0104834 A1 * 5/2005 Tsuchihashi ..... G09G 3/3614 345/96
2006/0092120 A1 * 5/2006 Nose ..... G09G 3/3614 345/98
2006/0145978 A1 * 7/2006 Takatori ..... G09G 3/2014 345/87
2006/0221035 A1 10/2006 Lee
2007/0247410 A1 * 10/2007 Yoshimoto ..... G09G 3/3677 345/98
2010/0156963 A1 * 6/2010 Shiomi ..... G09G 3/3648 345/691
2011/0149185 A1 * 6/2011 Yamazaki ..... H01L 27/1225 349/39
2011/0181560 A1 * 7/2011 Yamazaki ..... H01L 27/1225 345/204
2011/0285759 A1 * 11/2011 Sakai ..... G09G 3/3648 345/690
2013/0249880 A1 * 9/2013 Chen ..... G09G 3/36 345/211
2014/0368553 A1 * 12/2014 Chang ..... G09G 3/3614 345/690
2014/0375535 A1 * 12/2014 Tanaka ..... G09G 3/3648 345/92
2015/0332651 A1 * 11/2015 Miyazawa ..... G09G 3/3614 345/211

FOREIGN PATENT DOCUMENTS

JP 2010-039250 A 2/2010
JP 2010-113100 A 5/2010
WO 2012/060288 A1 5/2012

* cited by examiner

Fig.3
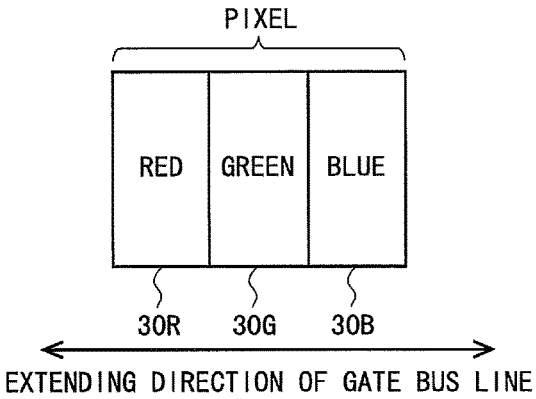
Fig.4
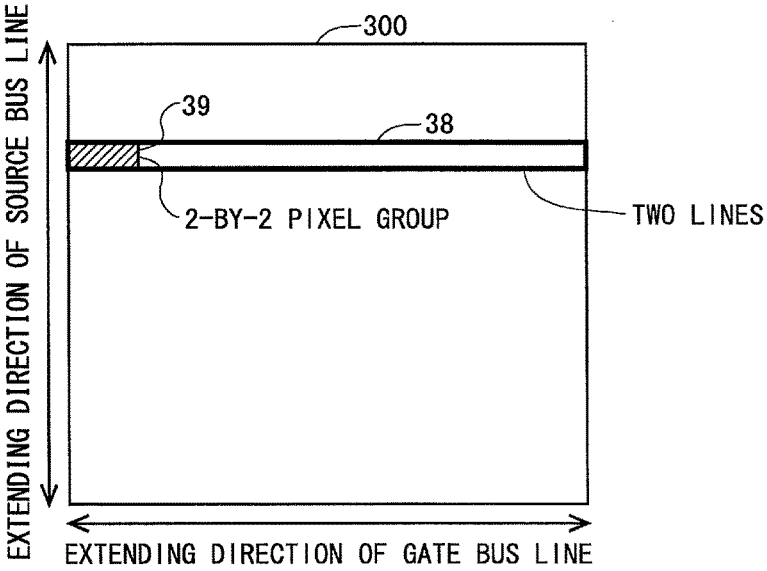
Fig.5
| | | | | | |
|---|---|---|---|---|---|
| R11 | G11 | B11 | R12 | G12 | B12 |
| R21 | G21 | B21 | R22 | G22 | B22 |

| | | | |
|---|---|---|---|
| + | − | + | − |
| + | − | + | − |
| − | + | − | + |
| − | + | − | + |

LIQUID CRYSTAL DISPLAY DEVICE AND METHOD FOR DRIVING SAME

TECHNICAL FIELD

The present invention relates to a liquid crystal display device. More particularly, the present invention relates to a liquid crystal display device that performs low-frequency driving, and a method for driving same.

BACKGROUND ART

Conventionally, there are demands for a reduction in power consumption in a display device such as a liquid crystal display device. In recent years, hence, developments have been made in a driving method involving "providing a pausing period between a writing period and a writing period in order to pause a write operation by bringing all gate bus lines (scanning signal lines) into a non-scanning state" for a liquid crystal display device. It should be noted that the writing period refers to a period for charging a pixel capacitance in a display unit, based on an image signal in one frame (one screen). The writing period is also called, for example, a scanning period, a charging period, or a refreshing period. According to the driving method described above, there is no need to apply, for example, a controlling signal to a liquid crystal drive circuit (e.g., a gate driver, a source driver) in the pausing period. Therefore, a drive frequency of the liquid crystal drive circuit is reduced as a whole, so that a reduction in power consumption can be realized. It should be noted that the driving method involving providing the pausing period for pausing the write operation is called, for example, "low-frequency driving" or "pause driving". FIG. 14 is a diagram for illustrating one example of the low-frequency driving. In a liquid crystal display device that employs the low-frequency driving, as shown in FIG. 14, for example, a writing period having a length corresponding to one frame period (one frame period: 16.67 ms) in a general liquid crystal display device having a refresh rate (a drive frequency) of 60 Hz and a pausing period having a length corresponding to a 59-frame period appear alternately. This low-frequency driving is suitable for still image display.

In recent years, attention has been given to a thin-film transistor using an oxide semiconductor as a channel layer (hereinafter, such a thin-film transistor is referred to as an "oxide TFT"). The oxide TFT has an off-leak current (i.e., a current to be flown in an OFF state) which is considerably smaller than that of a thin-film transistor using, for example, amorphous silicon as a channel layer (hereinafter, such a thin-film transistor is referred to as a "silicon-based TFT"). Therefore, a liquid crystal display device using an oxide TFT as an element in a liquid crystal panel is capable of holding a voltage written on a pixel capacitance, for a relatively long period of time. Accordingly, the low-frequency driving described above is particularly employed for a liquid crystal display device using the oxide TFT as an element in a liquid crystal panel. The low-frequency driving is occasionally employed for a liquid crystal display device using the silicon-based TFT as an element in a liquid crystal panel.

A liquid crystal has a characteristic in that the liquid crystal is degraded when being successively applied with a direct-current voltage. Accordingly, in order to suppress the degradation of a liquid crystal, a liquid crystal display device performs alternating-current driving of reversing the polarity of a pixel voltage (liquid crystal applied voltage). A driving scheme called frame-reversal driving of reversing the polarities of pixel voltages every frame in a state in which the polarities of the pixel voltages are made equal to one another in all pixels is known as an alternating-current driving scheme. It should be noted that, hereinafter, the driving scheme of reversing the polarity of a pixel voltage every predetermined period is referred to as a "reversal driving scheme". However, the frame-reversal driving relatively tends to cause flicker upon display of an image. So, conventionally, reversal driving schemes with various polarity reversal patterns have been employed in order to suppress the occurrence of flicker. Typically, line-reversal driving, column-reversal driving, and dot-reversal driving are known as the reversal driving scheme.

The line-reversal driving refers to a driving scheme of reversing the polarity of a pixel voltage every frame and every predetermined number of gate bus lines. When the polarity of the pixel voltage is reversed every frame and every gate bus line in this driving scheme, the polarities of pixel voltages on 4-by-4 pixels in a certain frame are as shown in FIG. 15. The polarities of the pixel voltages on all the pixels are reversed in a subsequent frame.

The column-reversal driving refers to a driving scheme of reversing the polarity of a pixel voltage every frame and every predetermined number of source bus lines. When the polarity of the pixel voltage is reversed every frame and every source bus line in this driving scheme, the polarities of pixel voltages on 4-by-4 pixels in a certain frame are as shown in FIG. 16. It should be noted that the polarities of the pixel voltages on all the pixels are reversed in a subsequent frame.

The dot-reversal driving refers to a driving scheme of reversing the polarity of a pixel voltage every frame and also reversing the polarities of adjacent pixels in vertical and horizontal directions. With regard to this driving scheme, the polarities of pixel voltages on 4-by-4 pixels in a certain frame are as shown in FIG. 17. It should be noted that the polarities of the pixel voltages on all the pixels are reversed in a subsequent frame. According to the dot-reversal driving, a polarity reversal pattern becomes complicated as compared with the line-reversal driving and the column-reversal driving. Therefore, the occurrence of flicker is effectively suppressed.

It should be noted that, in relation to this invention, Japanese Patent Application Laid-Open No. 2006-126475 discloses the invention of a liquid crystal display device capable of reducing power consumption and suppressing heat generation while suppressing the occurrence of flicker. In this liquid crystal display device, a reversal driving scheme is decided based on the gradation of input image data every plurality of pixels of a frame less than one frame.

PRIOR ART DOCUMENT

Patent Document

[Patent Document 1] Japanese Patent Application Laid-Open No. 2006-126475

SUMMARY OF THE INVENTION

Problems to be Solved by the Invention

According to the dot-reversal driving, however, it is necessary to increase the amplitude of a video signal to be applied to a source bus line. Therefore, power consumption is increased. Accordingly, in a liquid crystal display device that employs the low-frequency driving for the purpose of reducing power consumption, generally, the column-reversal driving is employed as a reversal driving scheme. In a liquid crystal display device that employs the column-reversal driving, flicker occurs upon display of an image (an image as shown in FIG. 18) which is analogous to a polarity reversal pattern (see FIG. 16) in the column-reversal driving. The reason why flicker occurs in the case described above is as follows. In a case where attention is given to one column (lengthwise line), the polarities of pixel voltages on all pixels are changed to positive in a certain frame, and the polarities of pixel voltages on all pixels are changed to negative in a subsequent frame. In a liquid crystal display device, as described above, flicker tends to occur upon display of an image which is analogous to a polarity reversal pattern in reversal driving.

Hence, an object of the present invention is to realize a liquid crystal display device capable of suppressing the occurrence of flicker irrespective of a displayed image.

Means for Solving the Problems

A first aspect of the present invention is directed to a liquid crystal display device for displaying an image by applying an alternating-current voltage to a liquid crystal, based on an input image signal, the liquid crystal display device comprising:

a display unit including a plurality of video signal lines for transmitting a plurality of video signals based on the input image signal, respectively, a plurality of scanning signal lines intersecting with the plurality of video signal lines, a plurality of switching elements arranged in a matrix form in correspondence with intersections between the plurality of video signal lines and the plurality of scanning signal lines, a plurality of pixel electrodes connected to the plurality of switching elements, respectively, and a common electrode disposed to face the plurality of pixel electrodes via the liquid crystal, the display unit configured to display the image based on the input image signal;

an image determination part configured to determine whether or not the image based on the input image signal is an image analogous to a first pattern which is a polarity reversal pattern in a first reversal driving scheme specified in advance for applying the alternating-current voltage to the liquid crystal, and to output a determination result;

a reversal driving scheme decision part configured to decide a reversal driving scheme for applying the alternating-current voltage to the liquid crystal, based on the determination result; and a liquid crystal drive unit configured to drive the liquid crystal by applying a predetermined voltage to the common electrode, applying the plurality of video signals to the corresponding video signal lines, respectively, and selectively driving the plurality of scanning signal lines, wherein with regard to each unit area where the determination by the image determination part is made, the reversal driving scheme decision part decides the reversal driving scheme for applying the alternating-current voltage to the liquid crystal in the unit area, as a second reversal driving scheme by which a second pattern which is a polarity reversal pattern different from the first pattern appears, when the determination result indicates that the image based on the input image signal is the image analogous to the first pattern, and the liquid crystal drive unit drives the liquid crystal by using the reversal driving scheme decided by the reversal driving scheme decision part, by controlling the polarities of the plurality of video signals.

According to a second aspect of the present invention, in the first aspect of the present invention, the liquid crystal drive unit applies different voltages to the common electrode at the time when a write operation based on the input image signal is performed in an area where the liquid crystal is driven by using the first reversal driving scheme and at the time when the write operation based on the input image signal is performed in an area where the liquid crystal is driven by using the second reversal driving scheme.

According to a third aspect of the present invention, in the first aspect of the present invention, the liquid crystal display device further comprises a reversal location storage part configured to hold reversal pattern instruction data indicating a reversal driving scheme for each unit area, wherein with regard to consecutive two frames including a first frame and a second frame, the reversal driving scheme decision part stores the reversal pattern instruction data in the reversal location storage part in the first frame, and decides a reversal driving scheme for each unit area as a reversal driving scheme equal to that in the first frame, based on the reversal pattern instruction data held by the reversal location storage part, in the second frame, and the image determination by the image determination part is not performed in the second frame.

According to a fourth aspect of the present invention, in the first aspect of the present invention, the first reversal driving scheme is column-reversal driving of reversing the polarity of the voltage applied to the liquid crystal every video signal line, and the second reversal driving scheme is dot-reversal driving of reversing the polarity of the voltage applied to the liquid crystal every scanning signal line and every video signal line.

According to a fifth aspect of the present invention, in the fourth aspect of the present invention, when a change occurs from a determination result that the image based on the input image signal is the image analogous to the first pattern to a determination result that the image based on the input image signal is not the image analogous to the first pattern, and when a change occurs from the determination result that the image based on the input image signal is not the image analogous to the first pattern to the determination result that the image based on the input image signal is the image analogous to the first pattern, the reversal driving scheme decision part decides the reversal driving scheme for applying the alternating-current voltage to the liquid crystal in an area including at least the unit area where the determination result is changed, as 2-line dot-reversal driving of reversing the polarity of the voltage applied to the liquid crystal every two scanning signal lines and every video signal line.

According to a sixth aspect of the present invention, in the fourth aspect of the present invention, the image determination part determines whether or not the image based on the input image signal is the image analogous to the first pattern every area corresponding to two scanning signal lines, and the reversal driving scheme decision part decides the reversal driving scheme for applying the alternating-current voltage to the liquid crystal every area corresponding to two scanning signal lines.

According to a seventh aspect of the present invention, in the sixth aspect of the present invention, the display unit includes a plurality of pixels each formed of three sub-pixels of red, green, and blue arranged in this order in an extending direction of the plurality of scanning signal lines, and the image determination part determines that the image based on the input image signal is the image analogous to the first pattern when both the following expressions (7) and (8) are satisfied based on calculation results of the following expressions (1) to (3) and calculation results of the following expressions (4) to (6), with a 2-by-2 pixel group defined as one image analyzing filter:

$$\text{Delta1}=\Sigma|(R11+R21)-(G11+G21)| \quad (1)$$

$$\text{Delta2}=\Sigma|(B11+B21)-(R12+R22)| \quad (2)$$

$$\text{Delta3}=\Sigma|(G12+G22)-(B12+B22)| \quad (3)$$

$$\text{Delta}R=\Sigma|R11-R12+R21-R22| \quad (4)$$

$$\text{Delta}G=\Sigma|G11-G12+G21-G22| \quad (5)$$

$$\text{Delta}B=\Sigma|B11-B12+B21-B22| \quad (6)$$

$$\text{Delta}Th\leq(\text{Delta1}+\text{Delta2}+\text{Delta3})/K \quad (7)$$

$$\text{Delta}ThCol\leq(\text{Delta}R+\text{Delta}G+\text{Delta}B)/K \quad (8)$$

in which R11, G11, and B11 represent pixel values of the red, green, and blue sub-pixels included in the pixel in the first row and first column, respectively; R12, G12, and B12 represent pixel values of the red, green, and blue sub-pixels included in the pixel in the first row and second column, respectively; R21, G21, and B21 represent pixel values of the red, green, and blue sub-pixels included in the pixel in the second row and first column, respectively; R22, G22, and B22 represent pixel values of the red, green, and blue sub-pixels included in the pixel in the second row and second column, respectively; K represents the number of pixels in the extending direction of the plurality of scanning signal lines; DeltaTh and DeltaThCol each represent a threshold value specified in advance; and Σ represents a sum of values obtained based on the image analyzing filters corresponding to all the 2-by-2 pixel groups in the extending direction of the plurality of scanning signal lines.

According to an eighth aspect of the present invention, in the fourth aspect of the present invention, the image determination part determines whether or not the image based on the input image signal is the image analogous to the first pattern every area corresponding to one scanning signal line, and the reversal driving scheme decision part decides the reversal driving scheme for applying the alternating-current voltage to the liquid crystal every area corresponding to one scanning signal line.

According to a ninth aspect of the present invention, in the eighth aspect of the present invention, the display unit includes a plurality of pixels each formed of three sub-pixels of red, green, and blue arranged in this order in an extending direction of the plurality of scanning signal lines, and the image determination part determines that the image based on the input image signal is the image analogous to the first pattern when both the following expressions (7) and (8) are satisfied based on calculation results of the following expressions (9) to (11) and calculation results of the following expressions (12) to (14), with a 1-by-2 pixel group defined as one image analyzing filter:

$$\text{Delta1}=\Sigma|(R11-G11)| \quad (9)$$

$$\text{Delta2}=\Sigma|(B11-R12)| \quad (10)$$

$$\text{Delta3}=\Sigma|(G12-B12)| \quad (11)$$

$$\text{Delta}R=\Sigma|R11-R12| \quad (12)$$

$$\text{Delta}G=\Sigma|G11-G12| \quad (13)$$

$$\text{Delta}B=\Sigma|B11-B12| \quad (14)$$

$$\text{Delta}Th\leq(\text{Delta1}+\text{Delta2}+\text{Delta3})/K \quad (7)$$

$$\text{Delta}ThCol\leq(\text{Delta}R+\text{Delta}G+\text{Delta}B)/K \quad (8)$$

in which R11, G11, and B11 represent pixel values of the red, green, and blue sub-pixels included in the pixel in the first row and first column, respectively; R12, G12, and B12 represent pixel values of the red, green, and blue sub-pixels included in the pixel in the first row and second column, respectively; K represents the number of pixels in the extending direction of the plurality of scanning signal lines; DeltaTh and DeltaThCol each represent a threshold value specified in advance; and Σ represents a sum of values obtained based on the image analyzing filters corresponding to all the 1-by-2 pixel groups in the extending direction of the plurality of scanning signal lines.

According to a tenth aspect of the present invention, in the fourth aspect of the present invention, the display unit includes a plurality of pixels, the image determination part determines whether or not the image based on the input image signal is the image analogous to the first pattern every area corresponding to a 2-by-2 pixel group, and the reversal driving scheme decision part decides the reversal driving scheme for applying the alternating-current voltage to the liquid crystal every area corresponding to a 2-by-2 pixel group.

According to an eleventh aspect of the present invention, in the tenth aspect of the present invention, each of the pixels is formed of three sub-pixels of red, green, and blue arranged in this order in the extending direction of the plurality of scanning signal lines, and the image determination part determines that the image based on the input image signal is the image analogous to the first pattern when both the following expressions (21) and (22) are satisfied based on calculation results of the following expressions (15) to (17) and calculation results of the following expressions (18) to (20), with the 2-by-2 pixel group defined as one image analyzing filter:

$$\text{Delta1}=|(R11+R21)-(G11+G21)| \quad (15)$$

$$\text{Delta2}=|(B11+B21)-(R12+R22)| \quad (16)$$

$$\text{Delta3}=|(G12+G22)-(B12+B22)| \quad (17)$$

$$\text{Delta}R=|R11-R12+R21-R22| \quad (18)$$

$$\text{Delta}G=|G11-G12+G21-G22| \quad (19)$$

$$\text{Delta}B=|B11-B12+B21-B22| \quad (20)$$

$$\text{Delta}Th\leq(\text{Delta1}+\text{Delta2}+\text{Delta3}) \quad (21)$$

$$\text{Delta}ThCol\leq(\text{Delta}R+\text{Delta}G+\text{Delta}B) \quad (22)$$

in which R11, G11, and B11 represent pixel values of the red, green, and blue sub-pixels included in the pixel in the first row and first column, respectively; R12, G12, and B12 represent pixel values of the red, green, and blue sub-pixels included in the pixel in the first row and second column, respectively; R21, G21, and B21 represent pixel values of the red, green, and blue sub-pixels included in the pixel in the second row and first column, respectively; R22, G22, and B22 represent pixel values of the red, green, and blue sub-pixels included in the pixel in the second row and second column, respectively; K represents the number of pixels in the extending direction of the plurality of scanning signal lines; and DeltaTh and DeltaThCol each represent a threshold value specified in advance.

According to a twelfth aspect of the present invention, in the first aspect of the present invention, a writing period having a length corresponding to one frame period in which the write operation based on the input image signal is performed and a pausing period having a length corresponding to a multiple-frame period in which the write operation based on the input image signal is paused are repeated alternately, and the determination by the image determination part is performed only in the writing period.

According to a thirteenth aspect of the present invention, in the first aspect of the present invention, the switching element is a thin-film transistor made of an oxide semiconductor.

According to a fourteenth aspect of the present invention, in the thirteenth aspect of the present invention, the oxide semiconductor is indium gallium zinc oxide.

A fifteenth aspect of the present invention is directed to a method for driving a liquid crystal display device for displaying an image by applying an alternating-current voltage to a liquid crystal, based on an input image signal, the liquid crystal display device including a display unit that includes a plurality of video signal lines for transmitting a plurality of video signals based on the input image signal, respectively, a plurality of scanning signal lines intersecting with the plurality of video signal lines, a plurality of switching elements arranged in a matrix form in correspondence with intersections between the plurality of video signal lines and the plurality of scanning signal lines, a plurality of pixel electrodes connected to the plurality of switching elements, respectively, and a common electrode disposed to face the plurality of pixel electrodes via the liquid crystal, the display unit configured to display the image based on the input image signal, the method comprising:

an image determining step of determining whether or not the image based on the input image signal is an image analogous to a first pattern which is a polarity reversal pattern in a first reversal driving scheme specified in advance for applying the alternating-current voltage to the liquid crystal, and outputting a determination result;

a reversal driving scheme deciding step of deciding a reversal driving scheme for applying the alternating-current voltage to the liquid crystal, based on the determination result; and a liquid crystal driving step of driving the liquid crystal by applying a predetermined voltage to the common electrode, applying the plurality of video signals to the corresponding video signal lines, respectively, and selectively driving the plurality of scanning signal lines, wherein in the reversal driving scheme deciding step, with regard to each unit area where the determination in the image determining step is made, the reversal driving scheme for applying the alternating-current voltage to the liquid crystal in the unit area is decided as a second reversal driving scheme by which a second pattern which is a polarity reversal pattern different from the first pattern appears, when the determination result indicates that the image based on the input image signal is the image analogous to the first pattern, and in the liquid crystal driving step, the liquid crystal is driven by using the reversal driving scheme decided in the reversal driving scheme deciding step, by controlling the polarities of the plurality of video signals.

Effects of the Invention

According to the first aspect of the present invention, when an image based on an input image signal is an image which is analogous to a polarity reversal pattern in a reversal driving scheme employed by default (initial setting), the liquid crystal is driven by using a reversal driving scheme different from the reversal driving scheme employed by default, in an area where the image is displayed. For example, in a liquid crystal display device that employs column-reversal driving by default as a reversal driving scheme, when an image based on an input image signal is an image which is analogous to a polarity reversal pattern in the column-reversal driving, a liquid crystal is driven by using a reversal driving scheme other than the column-reversal driving, in an area where the image is displayed. Thus, it is possible to suppress the occurrence of flicker irrespective of a displayed image.

According to the second aspect of the present invention, it is possible to set a voltage on the common electrode at a suitable value in accordance with a reversal driving scheme in an area where a write operation is performed, at the time when the write operation based on an input image signal is performed. Thus, it is possible to suppress the occurrence of flicker owing to a difference in optimum counter voltage according to a reversal driving scheme.

According to the third aspect of the present invention, in a case where attention is given to consecutive two frames, the liquid crystal is driven by the same reversal driving scheme in the preceding frame and the subsequent frame. Thus, it is possible to suppress variations in polarity of a liquid crystal applied voltage.

According to the fourth aspect of the present invention, a determination whether or not an image based on an input image signal is an image which is analogous to a polarity reversal pattern in column-reversal driving is made in a liquid crystal display device that employs the column-reversal driving by default as a reversal driving scheme. Moreover, dot-reversal driving is performed in an area where the image which is analogous to the polarity reversal pattern in the column-reversal driving is displayed. Thus, it is possible to suppress the occurrence of flicker. Further, the column-reversal driving is performed in an area where an image which is not analogous to the polarity reversal pattern in the column-reversal driving is displayed. This configuration allows a liquid crystal drive unit to operate such that power consumption is minimized as much as possible. Thus, it is possible to realize a liquid crystal display device capable of effectively suppressing the occurrence of flicker while suppressing an increase in power consumption.

According to the fifth aspect of the present invention, an area where 2-line dot-reversal driving is performed is provided between an area where the column-reversal driving is performed and an area where the dot-reversal driving is performed. A polarity reversal pattern in the 2-line dot-reversal driving is as if an intermediate pattern between the polarity reversal pattern in the column-reversal driving and the polarity reversal pattern in the dot-reversal driving. Therefore, a boundary between the polarity reversal patterns is less prone to being visually recognized by a viewer.

According to the sixth aspect of the present invention, a determination whether or not an image based on an input image signal is an image which is analogous to the polarity reversal pattern in the column-reversal driving is made every two lines. Moreover, the reversal driving scheme is controlled every two lines. Thus, it is possible to realize a liquid crystal display device capable of effectively suppressing the occurrence of flicker while suppressing an increase in power consumption, in a manner similar to that according to the fourth aspect.

According to the seventh aspect of the present invention, it is possible to realize a liquid crystal display device capable of effectively suppressing the occurrence of flicker while suppressing an increase in power consumption, in a manner similar to that according to the sixth aspect of the present invention.

According to the eighth aspect of the present invention, a determination by the image determination part is made every line. Therefore, there is no need to provide a line memory. Thus, it is possible to suppress the occurrence of flicker while suppressing an increase in power consumption, in a configuration that the capacitance of a memory to be installed in a liquid crystal display device is minimized as much as possible.

According to the ninth aspect of the present invention, it is possible to suppress the occurrence of flicker while suppressing an increase in power consumption, in a configuration that the capacitance of a memory to be installed in a liquid crystal display device is minimized as much as possible, in a manner similar to that according to the eighth aspect of the present invention.

According to the tenth aspect of the present invention, a determination by the image determination part is made every 2-by-2 pixels. Therefore, a reversal driving scheme is controlled more finely in accordance with an image based on an input image signal. Thus, it is possible to more effectively suppress the occurrence of flicker while suppressing an increase in power consumption.

According to the eleventh aspect of the present invention, it is possible to more effectively suppress the occurrence of flicker while suppressing an increase in power consumption, in a manner similar to that according to the tenth aspect of the present invention.

According to the twentieth aspect of the present invention, it is possible to produce a similar effect to that according to the first aspect of the present invention, in a liquid crystal display device that performs low-frequency driving.

According to the thirteenth aspect of the present invention, it is possible to produce a similar effect to that according to the first aspect of the present invention, in a liquid crystal display device employing, as a switching element, a thin-film transistor made of an oxide semiconductor.

According to the fourteenth aspect of the present invention, it is possible to produce a similar effect to that according to the first aspect of the present invention, in a liquid crystal display device employing, as a switching element, a thin-film transistor made of indium gallium zinc oxide (InGaZnOx).

According to the fifteenth aspect of the present invention, it is possible to produce a similar effect to that according to the first aspect of the present invention, in a method for driving a liquid crystal display device.

BRIEF DESCRIPTION OF THE DRAWINGS

FIG. 3 is a schematic diagram showing a configuration of a pixel, in the first embodiment.

FIG. 4 is a diagram for illustrating the control of a reversal driving scheme (the control of a polarity reversal pattern) in the first embodiment.

FIG. 5 is a diagram for illustrating the control of the reversal driving scheme (the control of the polarity reversal pattern) in the first embodiment.

MODES FOR CARRYING OUT THE INVENTION

Hereinafter, embodiments of the present invention will be described with reference to the attached drawings.

1. First Embodiment

1.1 Overall Configuration and Operations Overview

Figure 1:
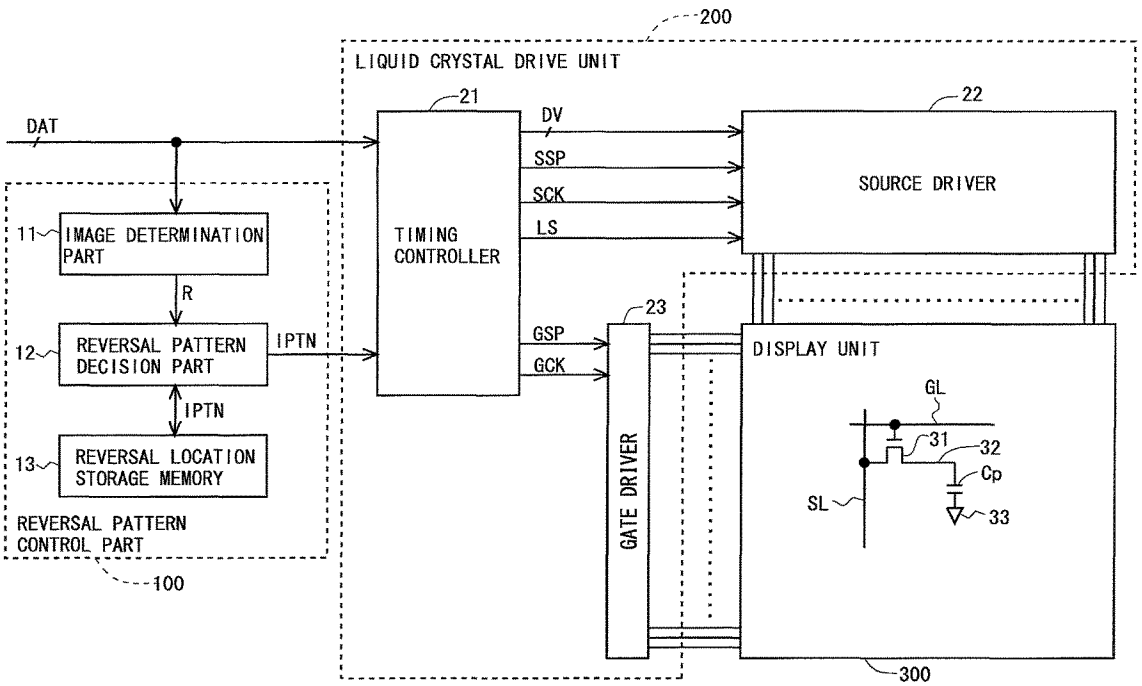
FIG. 1 is a block diagram showing an overall configuration of a liquid crystal display device according to a first embodiment of the present invention.

FIG. 1 is a block diagram showing an overall configuration of a liquid crystal display device according to a first embodiment of the present invention. The liquid crystal display device is constituted by a reversal pattern control part 100, a liquid crystal drive unit 200, and a display unit 300. It should be noted that the detailed configuration of the reversal pattern control part 100 will be described later. The liquid crystal drive unit 200 includes a timing controller 21, a source driver (video signal line drive circuit) 22, and a gate driver (scanning signal line drive circuit) 23.

Figure 2:
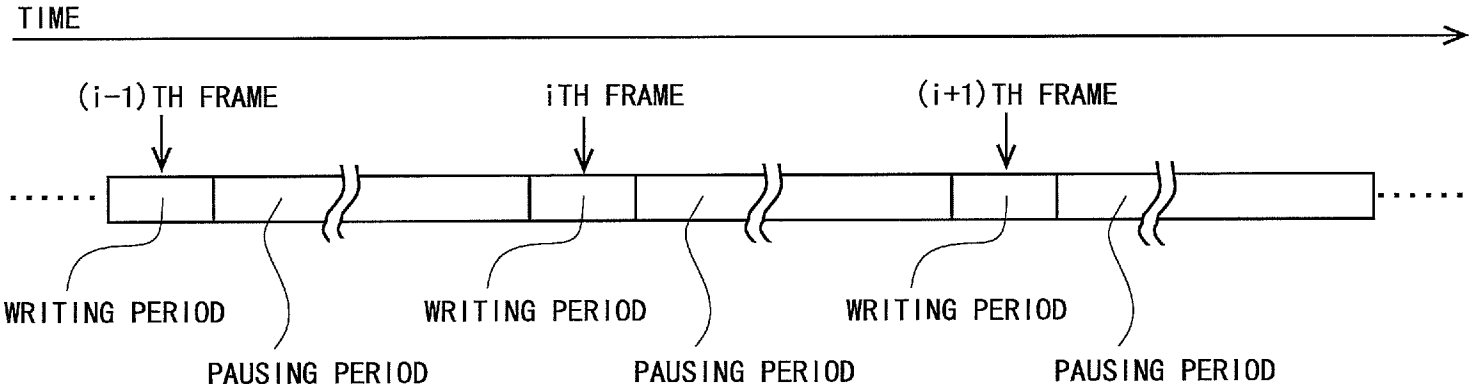
FIG. 2 is a diagram for illustrating a frame, in the first embodiment.
Figure 14:
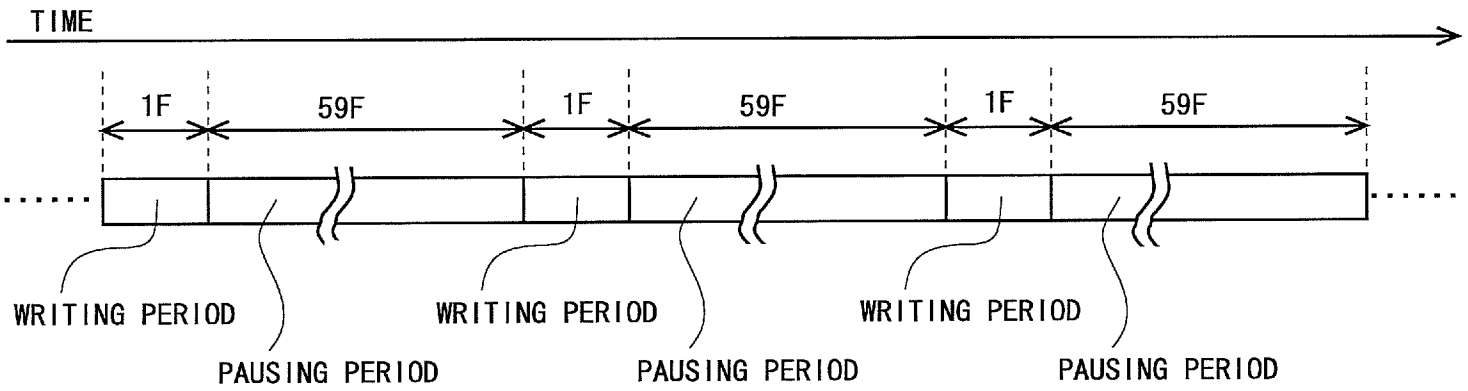
FIG. 14 is a diagram for illustrating one example of low-frequency driving.
Figure 15:
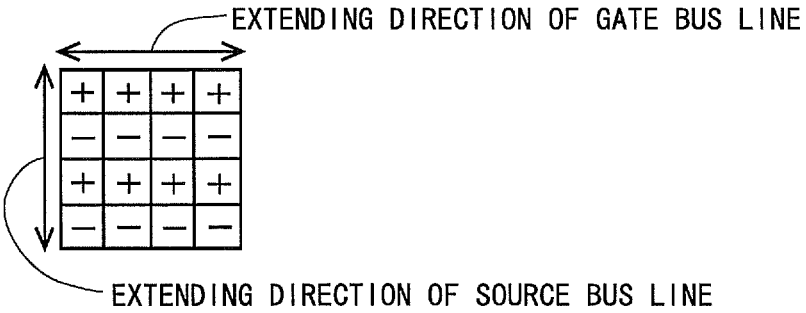
FIG. 15 is a diagram showing a polarity reversal pattern in line-reversal driving.

The liquid crystal display device according to the present embodiment typically performs low-frequency driving (see FIG. 14). That is, a pausing period having a length corresponding to a several- to several-tens-of-frame period is provided after a writing period for charging a pixel capacitance in a display unit. It should be noted that the present invention is also applicable to a liquid crystal display device that performs normal driving. As for explanation of a frame, a frame is referred to as, for example, an "(i−1)th frame", an "ith frame", or an "(i+1)th frame" (i: a natural number) (see FIG. 2) by paying attention to only the writing period in the entire operating period in the following. Accordingly, "consecutive two frames" refer to a certain writing period and a subsequent writing period.

Moreover, the liquid crystal display device according to the present embodiment employs column-reversal driving by default (initial setting) as a reversal driving scheme. As will be described later, however, the reversal driving scheme is controlled in accordance with a displayed image (i.e., an image based on an input image signal).

With regard to FIG. 1, a plurality of source bus lines (video signal lines) SL and a plurality of gate bus lines (scanning signal lines) GL are disposed on the display unit 300. A pixel formation portion that forms a pixel is provided in correspondence with each intersection between the source bus line SL and the gate bus line GL. In other words, the display unit 300 includes the plurality of pixel formation portions. The plurality of pixel formation portions are arranged in a matrix form to constitute a pixel array. Each pixel formation portion includes: a TFT (Thin-Film Transistor) 31 which is a switching element having a gate terminal connected to the gate bus line GL passing the corresponding intersection, and a source terminal connected to the source bus line SL passing the intersection; a pixel electrode 32 connected to a drain terminal of the TFT 31; a common electrode 33 which is a counter electrode for applying a common voltage to the plurality of pixel formation portions; and a liquid crystal (liquid crystal layer) commonly provided for the plurality of pixel formation portions and sandwiched between the pixel electrode 32 and the common electrode 33. A liquid crystal capacitance formed by the pixel electrode 32 and the common electrode 33 constitutes a pixel capacitance Cp. Generally, an auxiliary capacitance is provided in parallel with the liquid crystal capacitance in order that the pixel capacitance Cp securely holds a voltage. However, the auxiliary capacitance is not described and shown here because the auxiliary capacitance is not directly pertinent to the present invention. It should be noted that only the constituent elements of one pixel formation portion are shown in the display unit 300 in FIG. 1. In the present embodiment, as shown in FIG. 3, one pixel is formed of three sub-pixels, that is, red, green, and blue sub-pixels 30R, 30G, and 30B arranged in an extending direction of the gate bus line GL. One pixel formation portion shown in FIG. 1 forms one sub-pixel.

As described above, typically, the low-frequency driving is performed in the present embodiment. In the present embodiment, typically, an oxide TFT (i.e., a thin-film transistor using an oxide semiconductor as a channel layer) is used as the TFT 31 in the pixel formation portion. More specifically, a channel layer of the TFT 31 is made of InGaZnOx (Indium Gallium Zinc Oxide) mainly composed of indium (In), gallium (Ga), zinc (Zn), and oxygen (O). Hereinafter, a TFT using InGaZnOx as a channel layer is referred to as an "IGZO-TFT". By the way, a silicon-based TFT (i.e., a thin-film transistor using, for example, amorphous silicon as a channel layer) has a relatively large off-leak current. Therefore, in a case of using the silicon-based TFT as the TFT 31 in the pixel formation portion, an electric charge held by the pixel capacitance Cp is leaked via the TFT 31. As a result, a voltage to be held in an OFF state varies. In contrast to this, the IGZO-TFT has an off-leak current which is much smaller than that of the silicon-based TFT. Therefore, it is possible to hold a voltage (liquid crystal applied voltage) written in the pixel capacitance Cp for a longer period of time. Accordingly, the IGZO-TFT is suitably used in the case of performing the low-frequency driving. It should be noted that the similar effect can be produced also in a case of using, as a channel layer, an oxide semiconductor including at least one of indium, gallium, zinc, copper (Cu), silicon (Si), tin (Sn), aluminum (Al), calcium (Ca), germanium (Ge), lead (Pb), and the like, as the oxide semiconductor other than InGaZnOx. The oxide TFT used as the TFT 31 in the pixel formation portion is merely one example, and a silicon-based TFT or the like may be used in place of the oxide TFT.

Next, operations of the constituent elements shown in FIG. 1 are described. The reversal pattern control part 100 outputs reversal pattern instruction data IPTN indicating which reversal driving scheme (polarity reversal pattern) should be employed, based on an input image signal DAT. The detailed description of the reversal pattern instruction data IPTN will be given later. The liquid crystal drive unit 200 includes the timing controller 21, the source driver 22, and the gate driver 23, and drives the liquid crystal in the display unit 300, based on the input image signal DAT and the reversal pattern instruction data IPTN. The timing controller 21 receives the input image signal DAT and the reversal pattern instruction data IPTN. Then the timing controller 21 outputs a digital video signal DV; a source start pulse signal SSP, a source clock signal SCK, and a latch strobe signal LS which are for controlling the operation of the source driver 22; and a gate start pulse signal GSP and a gate clock signal GCK which are for controlling the operation of the gate driver 23. At this time, the timing controller 21 outputs these various signals such that the polarity reversal pattern based on the reversal driving scheme indicated by the reversal pattern instruction data IPTN appears. The source driver 22 applies a driving video signal to each source bus line SL, based on the digital video signal DV, the source start pulse signal SSP, the source clock signal SCK, and the latch strobe signal LS each output from the timing controller 21. The gate driver 23 applies a scanning signal to each gate bus line GL, based on the gate start pulse signal GSP and the gate clock signal GCK each output from the timing controller 21. Thus, the plurality of gate bus lines GL are selectively driven one by one.

Each source bus line SL is applied with the driving video signal and each gate bus line GL is applied with the scanning signal as described above, so that an image based on the input image signal DAT is displayed on the display unit 300.

1.2 Method of Controlling Reversal Driving Scheme (Polarity Reversal Pattern)

Next, a method of controlling the reversal driving scheme (polarity reversal pattern) in the present embodiment is described. In the present embodiment, a determination whether or not a displayed image is an image which is analogous to a polarity reversal pattern in the column-reversal driving is made based on the input image signal DAT. It should be noted that, hereinafter, "the image which is analogous to the polarity reversal pattern in the column-reversal driving" is referred to as a "column-reversal analogous image" for convenience of the description. The determination whether or not a displayed image is a column-reversal analogous image is made every two lines (i.e., an area corresponding to two gate bus lines). As to two lines where a displayed image is not a column-reversal analogous image, the liquid crystal drive unit 200 is controlled such that the column-reversal driving which is a default reversal driving scheme is performed. As to two lines where a displayed image is the column-reversal analogous image, on the other hand, the liquid crystal drive unit 200 is controlled such that a polarity reversal pattern which is different from the polarity reversal pattern in the column-reversal driving appears. As to two lines where the displayed image is the column-reversal analogous image, specifically, the liquid crystal drive unit 200 is controlled such that dot-reversal driving is performed.

The details of how to determine whether or not a displayed image is a column-reversal analogous image is described with reference to FIGS. 4 and 5. In the present embodiment, as described above, the determination is made every two lines. That is, an area corresponding to two lines corresponds to a unit area. When attention is given to each two lines (see reference character 38 in FIG. 4) in the display unit 300, a 2-by-2 pixel group (see reference character 39 in FIG. 4) is defined as one image analyzing filter, and the determination is made based on the following mathematical expressions using values of the pixels in the image analyzing filter. FIG. 5 is a schematic diagram of a 2-by-2 pixel group that constitutes one image analyzing filter. Each pixel is formed of three sub-pixels of R (red), G (green), and B (blue). It is assumed that a reference character shown in FIG. 5 is a variable indicating a pixel value of each sub-pixel. For example, R11 represents a pixel value of the red sub-pixel included in the pixel in the first row and first column, and B21 represents a pixel value of the blue sub-pixel included in the pixel in the second row and first column.

In the present embodiment, first, Delta1, Delta2, and Delta3 are calculated by the following expressions (1) to (3) in order to determine whether or not a displayed image is a column-reversal analogous image.

$$\text{Delta1}=\Sigma|(R11+R21)-(G11+G21)| \quad (1)$$

$$\text{Delta2}=\Sigma|(B11+B21)-(R12+R22)| \quad (2)$$

$$\text{Delta3}=\Sigma|(G12+G22)-(B12+B22)| \quad (3)$$

For example, in a case where 768 pixels are arranged in the extending direction of the gate bus line, 384 sets of 2-by-2 pixel groups exist as to each two lines. In this case, when an absolute value of "(R11+R21)−(G11+G21)" as to any set of 2-by-2 pixel groups is defined as X with regard to the above expression (1), Delta1 is equivalent to a sum of Xs for the 384 sets. The similar thing may hold true for the above expressions (2) and (3).

By the way, if the determination whether or not a displayed image is a column-reversal analogous image is made based on only the above expressions (1) to (3), the displayed image is determined as the column-reversal analogous image, even in a case where the displayed image is such an image that a screen is entirely displayed with a single color. In order to prevent such an image from being determined as the column-reversal analogous image, DeltaR, DeltaG, and DeltaB are calculated by the following expressions (4) to (6).

$$\text{Delta}R=\Sigma|R11-R12+R21-R22| \quad (4)$$

$$\text{Delta}G=\Sigma|G11-G12+G21-G22| \quad (5)$$

$$\text{Delta}B=\Sigma|B11-B12+B21-B22| \quad (6)$$

Further, a determination whether or not both the following expressions (7) and (8) are satisfied is made using Delta1, Delta2, Delta3, DeltaR, DeltaG, and DeltaB calculated by the above expressions (1) to (6).

$$\text{Delta}Th\leq(\text{Delta1}+\text{Delta2}+\text{Delta3})/K \quad (7)$$

$$\text{Delta}ThCol\leq(\text{Delta}R+\text{Delta}G+\text{Delta}B)/K \quad (8)$$

In the above expressions, K represents the number of pixels in the extending direction of the gate bus line (i.e., a horizontal resolution of a screen); and DeltaTh and DeltaThCol each represent a threshold value specified in advance. It should be noted that, in a case of a liquid crystal display device that performs gradation display with 256 gradations, for example, DeltaTh and DeltaThCol are set at a value of about 50.

As a result of the determination, when both the above expressions (7) and (8) are satisfied, it is determined that a displayed image in an area corresponding to two determination target lines is the column-reversal analogous image. Thus, the dot-reversal driving is performed in this area. When at least one of the above expressions (7) and (8) is not satisfied, it is determined that the displayed image in the area corresponding to the two determination target lines is not the column-reversal analogous image. Thus, the column-reversal driving is performed in this area.

Figure 16:
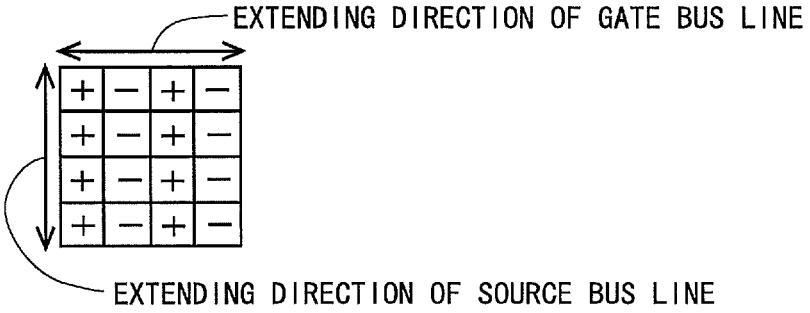
FIG. 16 is a diagram showing a polarity reversal pattern in column-reversal driving.
Figure 17:
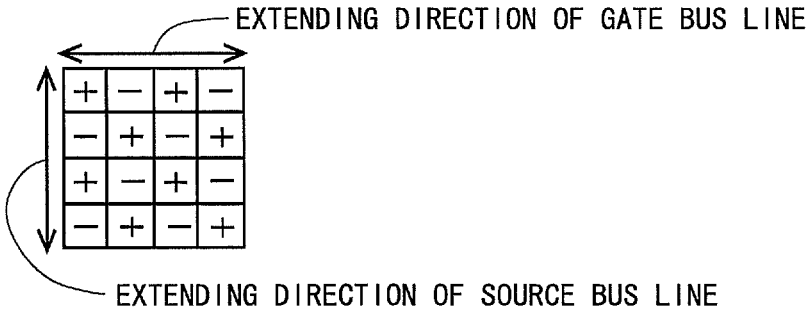
FIG. 17 is a diagram showing a polarity reversal pattern in dot-reversal driving.
Figure 18:
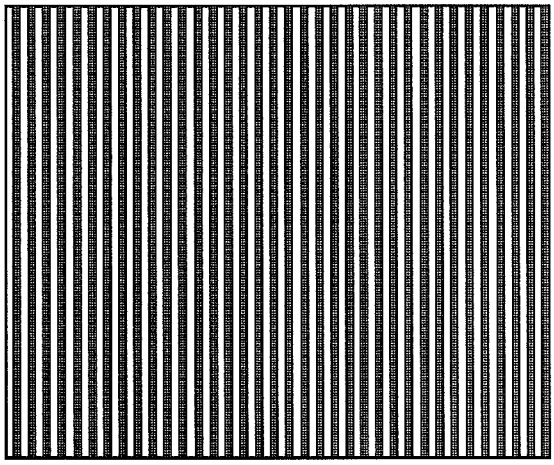
FIG. 18 is a diagram for illustrating a problem in a conventional example.

It should be noted that, in the present embodiment, the column-reversal driving corresponds to a first reversal driving scheme, and the dot-reversal driving corresponds to a second reversal driving scheme. Moreover, the polarity reversal pattern shown in FIG. 16 corresponds to a first pattern, and the polarity reversal pattern shown in FIG. 17 corresponds to a second pattern.

1.3 Configuration and Operation of Reversal Pattern Control Part

The configuration and operation of the reversal pattern control part 100 are described with the foregoing description taken into consideration. As shown in FIG. 1, the reversal pattern control part 100 includes an image determination part 11, a reversal pattern decision part 12, and a reversal location storage memory 13. In the present embodiment, the reversal pattern decision part 12 realizes a reversal driving scheme decision part.

The image determination part 11 determines whether or not a displayed image is a column-reversal analogous image, based on an input image signal DAT, and then outputs a determination result R. At this time, the image determination part 11 makes the determination every two lines by using the above expressions (1) to (8), as described above. In the present embodiment, accordingly, the image determination part 11 outputs, every two lines, the determination result R indicating whether or not the displayed image is the column-reversal analogous image. When attention is given to each pixel, in consecutive two frames, a pixel voltage in the second frame (subsequent frame) is opposite in polarity to a pixel voltage in the first frame (preceding frame). As to each two lines, therefore, a determination which reversal driving scheme is employed is preferably made once per two frames. Accordingly, the determination by the image determination part 11 is made once per two frames.

The reversal pattern decision part 12 outputs the reversal pattern instruction data IPTN indicating which reversal driving scheme (polarity reversal pattern) should be employed, based on the determination result R output from the image determination part 11. At this time, as to each two lines, when the determination result R indicates that "the displayed image is the column-reversal analogous image", the reversal pattern instruction data IPTN is set at a value indicating that "the dot-reversal driving should be employed". On the other hand, when the determination result R indicates that "the displayed image is not the column-reversal analogous image", the reversal pattern instruction data IPTN is set at a value indicating that "the column-reversal driving should be employed". In the present embodiment, the reversal pattern instruction data IPTN is constituted by one bit. For example, the reversal pattern instruction data IPTN is set at a value of "0" in the case where the column-reversal driving should be employed. On the other hand, the reversal pattern instruction data IPTN is set at a value of "1" in the case where the dot-reversal driving should be employed.

The reversal pattern instruction data IPTN is applied to the liquid crystal drive unit 200, and is stored in the reversal location storage memory 13. The liquid crystal drive unit 200 controls the polarity of the driving video signal, thereby driving the liquid crystal by using the reversal driving scheme indicated by the reversal pattern instruction data IPTN. The determination by the image determination part 11 is made every two lines as described above. Therefore, in a case of, for example, a liquid crystal display device having 1024 lines, 512 pieces of reversal pattern instruction data IPTN are stored in the reversal location storage memory 13.

The reversal location storage memory 13 is a memory for holding the reversal pattern instruction data IPTN for a 2-frame period. It should be noted that the reason why the reversal pattern instruction data IPTN is held as described above is as follows. As described above, when attention is given to each pixel, as to consecutive two frames, a pixel voltage in the second frame (subsequent frame) is opposite in polarity to a pixel voltage in the first frame (preceding frame). Accordingly, the determination by the image determination part 11 is made once per two frames. However, an image signal is written in the pixel capacitance Cp every frame in the display unit 300. Therefore, with regard to consecutive two frames, data indicating a reversal driving scheme is required at the time when writing of an image signal is performed in the first frame, and the data indicating the reversal driving scheme is also required at the time when writing of the image signal is performed in the second frame. For this reason, the reversal pattern instruction data IPTN should be held as the data indicating the reversal driving scheme in the reversal location storage memory 13 for the 2-frame period. By providing the reversal location storage memory 13, the reversal pattern decision part 12 is able to apply the reversal pattern instruction data IPTN indicating the reversal driving scheme, to the timing controller 21 in both the first and second frames of the consecutive two frames.

1.4 Effects

Figure 6:
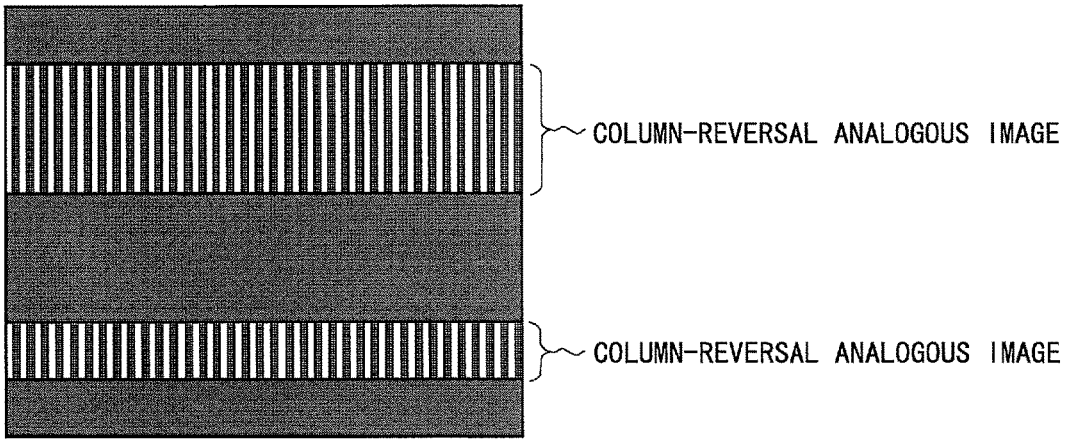
FIG. 6 is a diagram for illustrating an effect in the first embodiment.
Figure 7:
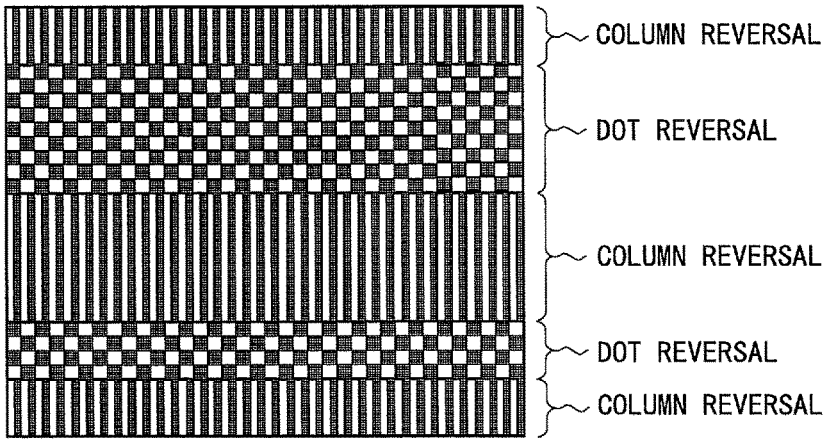
FIG. 7 is a diagram for illustrating the effect in the first embodiment.

According to the present embodiment, the determination whether or not a displayed image is a column-reversal analogous image is made based on an input image signal DAT every two lines. As a result of the determination, when the displayed image is the column-reversal analogous image, the dot-reversal driving is employed as the reversal driving scheme for two target lines. On the other hand, when the displayed image is not the column-reversal analogous image, the column-reversal driving is employed as the reversal driving scheme for the two target lines. Accordingly, when the displayed image is, for example, an image shown in FIG. 6, the polarity reversal pattern on the entire display unit 300 is as shown in FIG. 7 schematically. Thus, the dot-reversal driving is performed in the area where the column-reversal analogous image is displayed, so that the occurrence of flicker is suppressed. Moreover, the column-reversal driving is performed in an area other than the area where the column-reversal analogous image is displayed. Therefore, the liquid crystal drive unit 200 operates such that power consumption is minimized as much as possible. As described above, it is possible to realize a liquid crystal display device capable of effectively suppressing the occurrence of flicker while suppressing an increase in power consumption.

1.5 Modifications

Hereinafter, modifications of the first embodiment are described.

1.5.1 First Modification

In the first embodiment, the voltage (common electrode voltage Vcom) on the common electrode 33 is constant throughout the 1-frame period in which the write operation is performed. However, in the case where the common electrode voltage Vcom is made constant, there is apprehension that flicker occurs owing to a difference between an optimum counter voltage (the magnitude of the common electrode voltage Vcom to be set such that a charging rate in a case where a write operation with positive polarity is performed becomes equal to a charging rate in a case where a write operation with negative polarity is performed) in the column-reversal driving and an optimum counter voltage in the dot-reversal driving. In other words, in the case where the common electrode voltage Vcom is set at the optimum counter voltage in the column-reversal driving, there is apprehension that flicker occurs at the area where the dot-reversal driving is performed. Moreover, when the common electrode voltage Vcom is set at the optimum counter voltage in the dot-reversal driving, there is apprehension that flicker occurs at the area where the column-reversal driving is performed.

Figure 8:
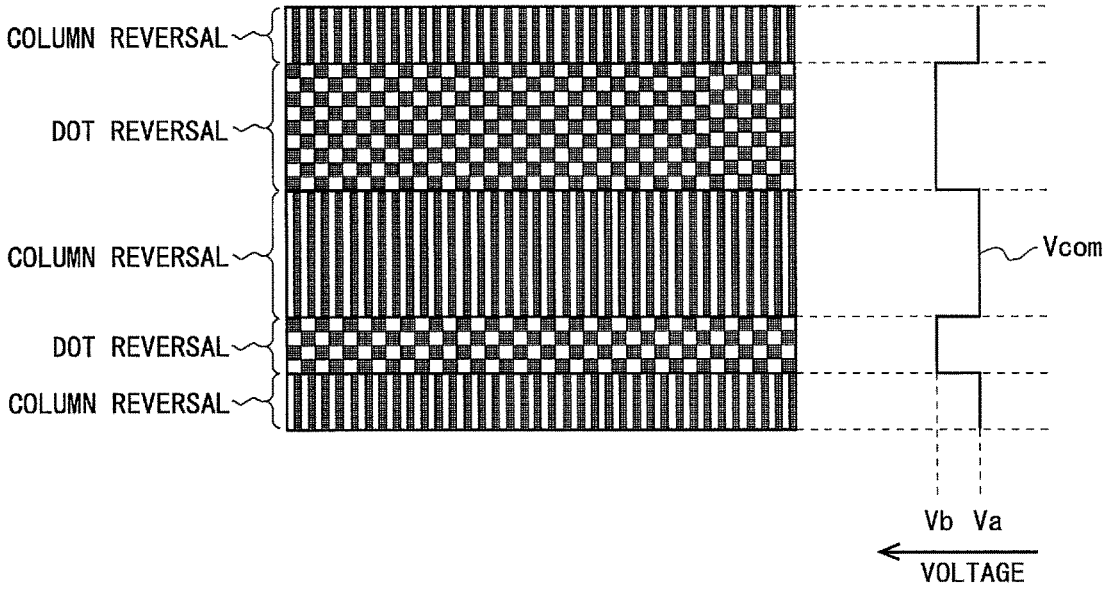
FIG. 8 is a diagram for illustrating the control of a common electrode voltage in a first modification of the first embodiment.

In the present modification, hence, the value of the common electrode voltage Vcom at the time when the write operation is performed in the area where the column-reversal driving is performed is set to be different from the value of the common electrode voltage Vcom at the time when the write operation is performed in the area where the dot-reversal driving is performed. In other words, the liquid crystal drive unit 200 applies, to the common electrode 33, different voltages at the time when the write operation is performed in the area where the column-reversal driving is performed and at the time when the write operation is performed in the area where the dot-reversal driving is performed. FIG. 8 is a diagram schematically showing this state. In the case where the write operation is performed in the area where the column-reversal driving is performed, the common electrode voltage Vcom is set at the optimum counter voltage Va in the column-reversal driving. In the case where the write operation is performed in the area where the dot-reversal driving is performed, the common electrode voltage Vcom is set at the optimum counter voltage Vb in the dot-reversal driving.

According to the present modification, as described above, at the time when an image signal is written in the pixel capacitance Cp, the value of the common electrode voltage Vcom is set at a suitable value in accordance with a reversal driving scheme in an area where the write operation is performed. Therefore, it is possible to suppress the occurrence of flicker owing to the difference between the optimum counter voltage in the column-reversal driving and the optimum counter voltage in the dot-reversal driving. Thus, it is possible to more effectively suppress the occurrence of flicker while suppressing an increase in power consumption, in the liquid crystal display device.

1.5.2 Second Modification

Figure 9:
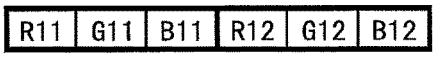
FIG. 9 is a diagram for illustrating the control of the reversal driving scheme (the control of the polarity reversal pattern) in a second modification of the first embodiment.

In the first embodiment, the image analyzing filter constituted by the 2-by-2 pixel group as shown in FIG. 5 is used for determining whether or not a displayed image is a column-reversal analogous image. In contrast to this, in the present modification, an image analyzing filter constituted of a 1-by-2 pixel group as shown in FIG. 9 is used. In the present modification, thus, a determination whether or not a displayed image is a column-reversal analogous image is made every line (an area corresponding to one gate bus line). That is, the area corresponding to one line corresponds to a unit area in the present modification.

In the present modification, first, Delta1, Delta2, and Delta3 are calculated by the following expressions (9) to (11) in order to determine whether or not a displayed image is a column-reversal analogous image.

$$\text{Delta1}=\Sigma|(R11-G11)| \quad (9)$$

$$\text{Delta2}=\Sigma|(B11-R12)| \quad (10)$$

$$\text{Delta3}=\Sigma|(G12-B12)| \quad (11)$$

Moreover, DeltaR, DeltaG, and DeltaB are calculated by the following expressions (12) to (14) in order to prevent such a displayed image that a screen is entirely displayed with a single color, from being determined as a column-reversal analogous image, in a manner similar to that in the first embodiment.

$$\text{Delta}R=\Sigma|R11-R12| \quad (12)$$

$$\text{Delta}G=\Sigma|G11-G12| \quad (13)$$

$$\text{Delta}B=\Sigma|B11-B12| \quad (14)$$

Further, a determination whether or not both the above expressions (7) and (8) are satisfied is made using Delta1, Delta2, Delta3, DeltaR, DeltaG, and DeltaB calculated by the above expressions (9) to (14), in a manner similar to that in the first embodiment.

As a result of the determination, when both the above expressions (7) and (8) are satisfied, it is determined that the displayed image in an area corresponding to one determination target line is the column-reversal analogous image. Thus, the dot-reversal driving is performed in this area. When at least one of the above expressions (7) and (8) is not satisfied, it is determined that the displayed image in the area corresponding to the one determination target line is not the column-reversal analogous image. Thus, the column-reversal driving is performed in this area.

In the first embodiment, the image analyzing filter constituted of the 2-by-2 pixel group (see FIG. 5) is used. Therefore, there is a need to provide a line memory for holding data corresponding to one line. In contrast to this, according to the present modification, the image analyzing filter constituted of the 1-by-2 pixel group (see FIG. 9) is used. Therefore, there is no need to provide a line memory. However, since the determination whether or not the displayed image is the column-reversal analogous image is made every line, the accuracy of image determination is lowered as compared with the first embodiment. Thus, it is possible to suppress the occurrence of flicker while suppressing an increase in power consumption, in the configuration that the capacitance of a memory to be installed in the liquid crystal display device is minimized as much as possible.

2. Second Embodiment

2.1 Configuration and Others

A second embodiment of the present invention is described. An overall configuration, an operations overview, and a configuration of a reversal pattern control part 100 are similar to those in the first embodiment; therefore, the description thereof will not be given (see FIG. 1).

2.2 Method of Controlling Reversal Driving Scheme (Polarity Reversal Pattern)

A method of controlling a reversal driving scheme (polarity reversal pattern) in the present embodiment is described. In the first embodiment, the reversal driving scheme is controlled every two lines. In contrast to this, a reversal driving scheme is controlled every 2-by-2 pixels as follows in the present embodiment. It should be noted that, in the present embodiment, an area corresponding to 2-by-2 pixels corresponds to a unit area.

In the present embodiment, first, Delta1, Delta2, and Delta3 are calculated by the following expressions (15) to (17) in order to determine whether or not a displayed image is a column-reversal analogous image.

$$\text{Delta1}=|(R11+R21)-(G11+G21)| \quad (15)$$

$$\text{Delta2}=|(B11+B21)-(R12+R22)| \quad (16)$$

$$\text{Delta3}=|(G12+G22)-(B12+B22)| \quad (17)$$

Moreover, DeltaR, DeltaG, and DeltaB are calculated by the following expressions (18) to (20) in order to prevent such a displayed image that a screen is entirely displayed with a single color, from being determined as a column-reversal analogous image, in a manner similar to that in the first embodiment.

$$\text{Delta}R=|R11-R12+R21-R22| \quad (18)$$

$$\text{Delta}G=|G11-G12+G21-G22| \quad (19)$$

$$\text{Delta}B=|B11-B12+B21-B22| \quad (20)$$

Further, a determination whether or not both the following expressions (21) and (22) are satisfied is made using Delta1, Delta2, Delta3, DeltaR, DeltaG, and DeltaB calculated by the above expressions (15) to (20).

$$\text{Delta}Th\leq(\text{Delta1}+\text{Delta2}+\text{Delta3}) \quad (21)$$

$$\text{Delta}ThCol\leq(\text{Delta}R+\text{Delta}G+\text{Delta}B) \quad (22)$$

As a result of the determination, when both the above expressions (21) and (22) are satisfied, it is determined that a displayed image in an area corresponding to determination target 2-by-2 pixels is the column-reversal analogous image. Thus, the dot-reversal driving is performed in this area. When at least one of the above expressions (21) and (22) is not satisfied, it is determined that the displayed image in the area corresponding to the determination target 2-by-2 pixels is not the column-reversal analogous image. Thus, the column-reversal driving is performed in this area.

2.3 Effects

Figure 10:
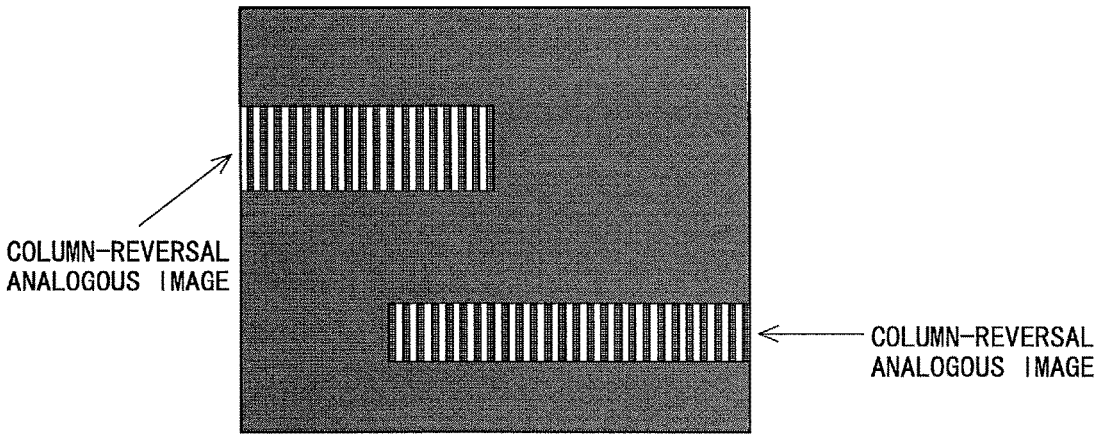
FIG. 10 is a diagram for illustrating an effect in a second embodiment of the present invention.
Figure 11:
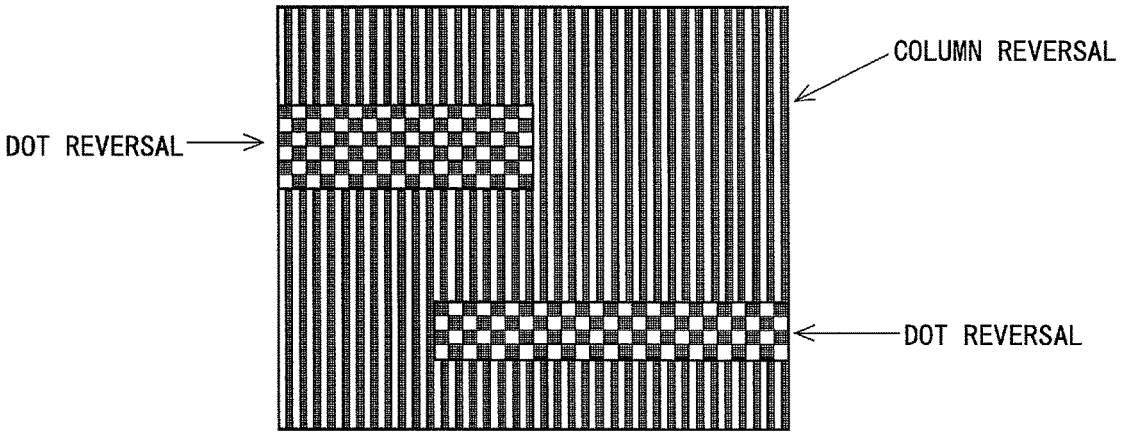
FIG. 11 is a diagram for illustrating the effect in the second embodiment.

According to the present embodiment, the determination whether or not a displayed image is a column-reversal analogous image is made based on an input image signal DAT every 2-by-2 pixels. As a result of the determination, when the displayed image is the column-reversal analogous image, the dot-reversal driving is employed as a reversal driving scheme in an area corresponding to target 2-by-2 pixels. On the other hand, when the displayed image is not the column-reversal analogous image, the column-reversal driving is employed as the reversal driving scheme in the area corresponding to the target 2-by-2 pixels. Accordingly, when the displayed image is, for example, an image shown in FIG. 10, the polarity reversal pattern on the entire display unit 300 is as shown in FIG. 11 schematically. As described above, the control of the reversal driving scheme (the control of the polarity reversal pattern) is performed more finely in accordance with a displayed image, as compared with the first embodiment. Thus, it is possible to more effectively suppress the occurrence of flicker while suppressing an increase in power consumption, in the liquid crystal display device.

It should be noted that, in the present embodiment, data indicating a reversal driving scheme (i.e., reversal pattern instruction data IPTN) is required every 2-by-2 pixels. Therefore, the required capacitance of the reversal location storage memory 13 is increased as compared with the first embodiment.

3. Third Embodiment

3.1 Configuration and Others

A third embodiment of the present invention is described. An overall configuration, an operations overview, and a configuration of a reversal pattern control part 100 are similar to those in the first embodiment; therefore, the description thereof will not be given (see FIG. 1).

3.2 Method of Controlling Reversal Driving Scheme (Polarity Reversal Pattern)

Figures 12, 13:
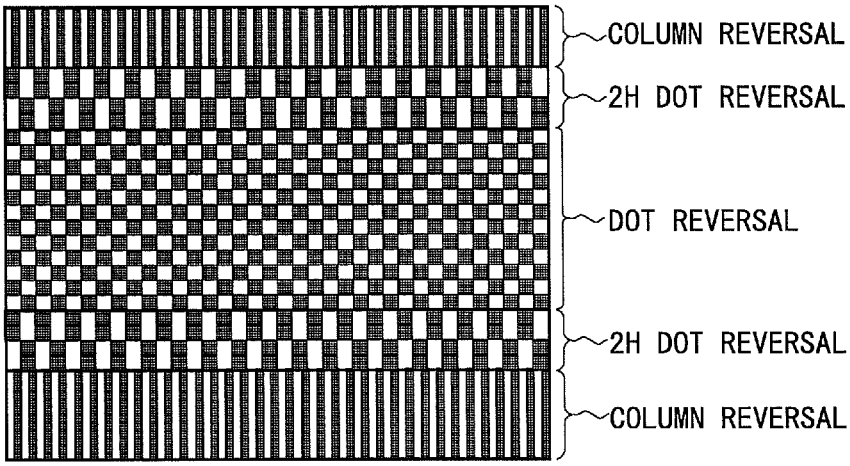
FIG. 12 is a diagram for illustrating the control of a reversal driving scheme (the control of a polarity reversal pattern) in a third embodiment of the present invention.
FIG. 13 is a diagram showing a polarity reversal pattern in 2H dot-reversal driving, in the third embodiment.

A method of controlling a reversal driving scheme (polarity reversal pattern) in the present embodiment is described. When the reversal driving scheme is suddenly changed spatially from the column-reversal driving to the dot-reversal driving (or from the dot-reversal driving to the column-reversal driving) as described in the first and second embodiments, a viewer sometimes visually recognizes a boundary between the polarity reversal patterns. In the present embodiment, hence, as shown in FIG. 12, an area where 2H dot-reversal driving (2-line dot-reversal driving) is performed is provided between an area where the column-reversal driving is performed and an area where the dot-reversal driving is performed. It should be noted that FIG. 13 is a diagram showing a polarity reversal pattern in the 2H dot-reversal driving.

Specifically, attention is given to a determination result R by an image determination part 11 every two lines in an extending direction of a source bus line. When a line where a change occurs from the determination result that "a displayed image is a column-reversal analogous image" to the determination result that "the displayed image is not the column-reversal analogous image" is defined as a first image change line and when a line where a change occurs from the determination result that "the displayed image is not the column-reversal analogous image" to the determination result that "the displayed image is the column-reversal analogous image" is defined as a second image change line, the 2H dot-reversal driving is employed as a reversal driving scheme for the 2n (n: a natural number) line from the first image change line and a reversal driving scheme for the 2m (m: a natural number) line from the second image change line.

It should be noted that, in order to realize such a control method, reversal pattern instruction data IPTN is 2-bit data, in the present embodiment. For example, the reversal pattern instruction data IPTN is set at a value of "00" in the case where the column-reversal driving should be employed, the reversal pattern instruction data IPTN is set at a value of "01" in the case where the dot-reversal driving should be employed, and the reversal pattern instruction data IPTN is set at a value of "10" in the case where the 2H dot-reversal driving should be employed. As described above, the reversal pattern instruction data IPTN is 2-bit data. Therefore, the required capacitance of a reversal location storage memory 13 is increased as compared with the first embodiment.

3.3 Effects

According to the present embodiment, the area where the 2H dot-reversal driving is performed is provided between the area where the column-reversal driving is performed and the area where the dot-reversal driving is performed. As understood from FIGS. 13, 16, and 17, the polarity reversal pattern in the 2H dot-reversal driving is as if an intermediate pattern between the polarity reversal pattern in the column-reversal driving and the polarity reversal pattern in the dot-reversal driving. Therefore, it is possible to produce such an effect that a boundary between the polarity reversal patterns is less prone to being visually recognized by a viewer.

It should be noted that a value of the common electrode voltage Vcom may be changed in accordance with a reversal driving scheme in an area where a write operation is performed, in a manner similar to that in the first modification of the first embodiment. Moreover, the determination whether or not a displayed image is a column-reversal analogous image may be made using an image analyzing filter constituted by a 1-by-2 pixel group, in a manner similar to that in the second modification of the first embodiment.

4. Others

In the foregoing respective embodiments, the column-reversal driving is employed by default (initial setting) as a reversal driving scheme, and the reversal driving scheme is controlled based on a determination whether or not a displayed image is a column-reversal analogous image; however, the present invention is not limited thereto. In a liquid crystal display device that employs any reversal driving scheme by default, when a displayed image in a certain area is an image which is analogous to a polarity reversal pattern, a reversal driving scheme which is different from the reversal driving scheme employed by default may be employed in this area. For example, in a liquid crystal display device that employs the line-reversal driving by default, when a displayed image in a certain area is an image which is analogous to the polarity reversal pattern in the line-reversal driving, the dot-reversal driving may be employed in this area.

DESCRIPTION OF REFERENCE CHARACTERS

11: IMAGE DETERMINATION PART
12: REVERSAL PATTERN DECISION PART
13: REVERSAL LOCATION STORAGE MEMORY

21: TIMING CONTROLLER
22: SOURCE DRIVER (VIDEO SIGNAL LINE DRIVE CIRCUIT)
23: GATE DRIVER (SCANNING SIGNAL LINE DRIVE CIRCUIT)
31: TFT (THIN-FILM TRANSISTOR)
32: PIXEL ELECTRODE
33: COMMON ELECTRODE
100: REVERSAL PATTERN CONTROL PART
200: LIQUID CRYSTAL DRIVE UNIT
300: DISPLAY UNIT
GL: GATE BUS LINE
SL: SOURCE BUS LINE
DAT: INPUT IMAGE SIGNAL
R: DETERMINATION RESULT
IPTN: REVERSAL PATTERN INSTRUCTION DATA

The invention claimed is:

1. A liquid crystal display device for displaying an image by applying an alternating-current voltage to a liquid crystal, based on an input image signal, the liquid crystal display device comprising:

a display unit including a plurality of video signal lines for transmitting a plurality of video signals based on the input image signal, respectively, a plurality of scanning signal lines intersecting with the plurality of video signal lines, a plurality of switching elements arranged in a matrix form in correspondence with intersections between the plurality of video signal lines and the plurality of scanning signal lines, a plurality of pixel electrodes connected to the plurality of switching elements, respectively, and a common electrode disposed to face the plurality of pixel electrodes via the liquid crystal, the display unit configured to display the image based on the input image signal;

an image determination part configured to determine whether or not the image based on the input image signal is an image analogous to a first pattern which is a polarity reversal pattern in a first reversal driving scheme specified in advance for applying the alternating-current voltage to the liquid crystal, and to output a determination result;

a reversal driving scheme decision part configured to decide a reversal driving scheme for applying the alternating-current voltage to the liquid crystal, based on the determination result; and a liquid crystal drive unit configured to drive the liquid crystal by applying a predetermined voltage to the common electrode, applying the plurality of video signals to the corresponding video signal lines, respectively, and selectively driving the plurality of scanning signal lines, wherein with regard to each unit area where the determination by the image determination part is made, the reversal driving scheme decision part decides the reversal driving scheme for applying the alternating-current voltage to the liquid crystal in the unit area, as a second reversal driving scheme by which a second pattern which is a polarity reversal pattern different from the first pattern appears, when the determination result indicates that the image based on the input image signal is the image analogous to the first pattern, the liquid crystal drive unit drives the liquid crystal by using the reversal driving scheme decided by the reversal driving scheme decision part, by controlling the polarities of the plurality of video signals, the first reversal driving scheme is column-reversal driving of reversing the polarity of the voltage applied to the liquid crystal every video signal line, the second reversal driving scheme is dot-reversal driving of reversing the polarity of the voltage applied to the liquid crystal every scanning signal line and every video signal line, the image determination part determines whether or not the image based on the input image signal is the image analogous to the first pattern every area corresponding to two scanning signal lines, the reversal driving scheme decision part decides the reversal driving scheme for applying the alternating-current voltage to the liquid crystal every area corresponding to two scanning signal lines, the display unit includes a plurality of pixels each formed of three sub-pixels of red, green, and blue arranged in this order in an extending direction of the plurality of scanning signal lines, and the image determination part determines that the image based on the input image signal is the image analogous to the first pattern when both the following expressions (7) and (8) are satisfied based on calculation results of the following expressions (1) to (3) and calculation results of the following expressions (4) to (6), with a 2-by-2 pixel group defined as one image analyzing filter:

$$\text{Delta1}=\Sigma|(R11+R21)-(G11+G21)| \quad (1)$$

$$\text{Delta2}=\Sigma|(B11+B21)-(R12+R22)| \quad (2)$$

$$\text{Delta3}=\Sigma|(G12+G22)-(B12+B22)| \quad (3)$$

$$\text{Delta}R=\Sigma|R11-R12+R21-R22| \quad (4)$$

$$\text{Delta}G=\Sigma|G11-G12+G21-G22| \quad (5)$$

$$\text{Delta}B=\Sigma|B11-B12+B21-B22| \quad (6)$$

$$\text{Delta}Th\leq(\text{Delta1}+\text{Delta2}+\text{Delta3})/K \quad (7)$$

$$\text{Delta}ThCol\leq(\text{Delta}R+\text{Delta}G+\text{Delta}B)/K \quad (8)$$

in which R11, G11, and B11 represent pixel values of the red, green, and blue sub-pixels included in the pixel in the first row and first column, respectively; R12, G12, and B12 represent pixel values of the red, green, and blue sub-pixels included in the pixel in the first row and second column, respectively; R21, G21, and B21 represent pixel values of the red, green, and blue sub-pixels included in the pixel in the second row and first column, respectively; R22, G22, and B22 represent pixel values of the red, green, and blue sub-pixels included in the pixel in the second row and second column, respectively; K represents the number of pixels in the extending direction of the plurality of scanning signal lines; DeltaTh and DeltaThCol each represent a threshold value specified in advance; and Σ represents a sum of values obtained based on the image analyzing filters corresponding to all the 2-by-2 pixel groups in the extending direction of the plurality of scanning signal lines.

2. The liquid crystal display device according to claim 1, wherein the liquid crystal drive unit applies different voltages to the common electrode at the time when a write operation based on the input image signal is performed in an area where the liquid crystal is driven by using the first reversal driving scheme and at the time when the write operation based on the input image signal is performed in an area where the liquid crystal is driven by using the second reversal driving scheme.

3. The liquid crystal display device according to claim 1, further comprising a reversal location storage part configured to hold reversal pattern instruction data indicating a reversal driving scheme for each unit area, wherein with regard to consecutive two frames including a first frame and a second frame, the reversal driving scheme decision part stores the reversal pattern instruction data in the reversal location storage part in the first frame, and decides a reversal driving scheme for each unit area as a reversal driving scheme equal to that in the first frame, based on the reversal pattern instruction data held by the reversal location storage part, in the second frame, and the image determination by the image determination part is not performed in the second frame.

4. The liquid crystal display device according to claim 1, wherein when a change occurs from a determination result that the image based on the input image signal is the image analogous to the first pattern to a determination result that the image based on the input image signal is not the image analogous to the first pattern, and when a change occurs from the determination result that the image based on the input image signal is not the image analogous to the first pattern to the determination result that the image based on the input image signal is the image analogous to the first pattern, the reversal driving scheme decision part decides the reversal driving scheme for applying the alternating-current voltage to the liquid crystal in an area including at least the unit area where the determination result is changed, as 2-line dot-reversal driving of reversing the polarity of the voltage applied to the liquid crystal every two scanning signal lines and every video signal line.

5. The liquid crystal display device according to claim 1, wherein a writing period having a length corresponding to one frame period in which the write operation based on the input image signal is performed and a pausing period having a length corresponding to a multiple-frame period in which the write operation based on the input image signal is paused are repeated alternately, and the determination by the image determination part is performed only in the writing period.

6. The liquid crystal display device according to claim 1, wherein the switching element is a thin-film transistor made of an oxide semiconductor.

7. The liquid crystal display device according to claim 6, wherein the oxide semiconductor is indium gallium zinc oxide.

8. A liquid crystal display device for displaying an image by applying an alternating-current voltage to a liquid crystal, based on an input image signal, the liquid crystal display device comprising:

a display unit including a plurality of video signal lines for transmitting a plurality of video signals based on the input image signal, respectively, a plurality of scanning signal lines intersecting with the plurality of video signal lines, a plurality of switching elements arranged in a matrix form in correspondence with intersections between the plurality of video signal lines and the plurality of scanning signal lines, a plurality of pixel electrodes connected to the plurality of switching elements, respectively, and a common electrode disposed to face the plurality of pixel electrodes via the liquid crystal, the display unit configured to display the image based on the input image signal;

an image determination part configured to determine whether or not the image based on the input image signal is an image analogous to a first pattern which is a polarity reversal pattern in a first reversal driving scheme specified in advance for applying the alternating-current voltage to the liquid crystal, and to output a determination result;

a reversal driving scheme decision part configured to decide a reversal driving scheme for applying the alternating-current voltage to the liquid crystal, based on the determination result; and a liquid crystal drive unit configured to drive the liquid crystal by applying a predetermined voltage to the common electrode, applying the plurality of video signals to the corresponding video signal lines, respectively, and selectively driving the plurality of scanning signal lines, wherein with regard to each unit area where the determination by the image determination part is made, the reversal driving scheme decision part decides the reversal driving scheme for applying the alternating-current voltage to the liquid crystal in the unit area, as a second reversal driving scheme by which a second pattern which is a polarity reversal pattern different from the first pattern appears, when the determination result indicates that the image based on the input image signal is the image analogous to the first pattern, the liquid crystal drive unit drives the liquid crystal by using the reversal driving scheme decided by the reversal driving scheme decision part, by controlling the polarities of the plurality of video signals, the first reversal driving scheme is column-reversal driving of reversing the polarity of the voltage applied to the liquid crystal every video signal line, the second reversal driving scheme is dot-reversal driving of reversing the polarity of the voltage applied to the liquid crystal every scanning signal line and every video signal line, the image determination part determines whether or not the image based on the input image signal is the image analogous to the first pattern every area corresponding to one scanning signal line, the reversal driving scheme decision part decides the reversal driving scheme for applying the alternating-current voltage to the liquid crystal every area corresponding to one scanning signal line, the display unit includes a plurality of pixels each formed of three sub-pixels of red, green, and blue arranged in this order in an extending direction of the plurality of scanning signal lines, and the image determination part determines that the image based on the input image signal is the image analogous to the first pattern when both the following expressions (7) and (8) are satisfied based on calculation results of the following expressions (9) to (11) and calculation results of the following expressions (12) to (14), with a 1-by-2 pixel group defined as one image analyzing filter:

$$\text{Delta1}=\Sigma|(R11-G11)| \quad (9)$$

$$\text{Delta2}=\Sigma|(B11-R12)| \quad (10)$$

$$\text{Delta3}=\Sigma|(G12-B12)| \quad (11)$$

$$\text{Delta}R=\Sigma|R11-R12| \quad (12)$$

$$\text{Delta}G=\Sigma|G11-G12| \quad (13)$$

$$\text{Delta}B=\Sigma|B11-B12| \quad (14)$$

$$\text{Delta}Th\leq(\text{Delta}1+\text{Delta}2+\text{Delta}3)/K \quad (7)$$

$$\text{Delta}ThCol\leq(\text{Delta}R+\text{Delta}G+\text{Delta}B)/K \quad (8)$$

in which R11, G11, and B11 represent pixel values of the red, green, and blue sub-pixels included in the pixel in the first row and first column, respectively; R12, G12, and B12 represent pixel values of the red, green, and blue sub-pixels included in the pixel in the first row and second column, respectively; K represents the number of pixels in the extending direction of the plurality of scanning signal lines; DeltaTh and DeltaThCol each represent a threshold value specified in advance; and Σ represents a sum of values obtained based on the image analyzing filters corresponding to all the 1-by-2 pixel groups in the extending direction of the plurality of scanning signal lines.

9. A liquid crystal display device for displaying an image by applying an alternating-current voltage to a liquid crystal, based on an input image signal, the liquid crystal display device comprising:

a display unit including a plurality of video signal lines for transmitting a plurality of video signals based on the input image signal, respectively, a plurality of scanning signal lines intersecting with the plurality of video signal lines, a plurality of switching elements arranged in a matrix form in correspondence with intersections between the plurality of video signal lines and the plurality of scanning signal lines, a plurality of pixel electrodes connected to the plurality of switching elements, respectively, and a common electrode disposed to face the plurality of pixel electrodes via the liquid crystal, the display unit configured to display the image based on the input image signal;

an image determination part configured to determine whether or not the image based on the input image signal is an image analogous to a first pattern which is a polarity reversal pattern in a first reversal driving scheme specified in advance for applying the alternating-current voltage to the liquid crystal, and to output a determination result;

a reversal driving scheme decision part configured to decide a reversal driving scheme for applying the alternating-current voltage to the liquid crystal, based on the determination result; and a liquid crystal drive unit configured to drive the liquid crystal by applying a predetermined voltage to the common electrode, applying the plurality of video signals to the corresponding video signal lines, respectively, and selectively driving the plurality of scanning signal lines, wherein with regard to each unit area where the determination by the image determination part is made, the reversal driving scheme decision part decides the reversal driving scheme for applying the alternating-current voltage to the liquid crystal in the unit area, as a second reversal driving scheme by which a second pattern which is a polarity reversal pattern different from the first pattern appears, when the determination result indicates that the image based on the input image signal is the image analogous to the first pattern, the liquid crystal drive unit drives the liquid crystal by using the reversal driving scheme decided by the reversal driving scheme decision part, by controlling the polarities of the plurality of video signals, the first reversal driving scheme is column-reversal driving of reversing the polarity of the voltage applied to the liquid crystal every video signal line, the second reversal driving scheme is dot-reversal driving of reversing the polarity of the voltage applied to the liquid crystal every scanning signal line and every video signal line, the display unit includes a plurality of pixels, the image determination part determines whether or not the image based on the input image signal is the image analogous to the first pattern every area corresponding to a 2-by-2 pixel group, the reversal driving scheme decision part decides the reversal driving scheme for applying the alternating-current voltage to the liquid crystal every area corresponding to a 2-by-2 pixel group, each of the pixels is formed of three sub-pixels of red, green, and blue arranged in this order in the extending direction of the plurality of scanning signal lines, and the image determination part determines that the image based on the input image signal is the image analogous to the first pattern when both the following expressions (21) and (22) are satisfied based on calculation results of the following expressions (15) to (17) and calculation results of the following expressions (18) to (20), with the 2-by-2 pixel group defined as one image analyzing filter:

$$\text{Delta}1=|(R11+R21)-(G11+G21)| \quad (15)$$

$$\text{Delta}2=|(B11+B21)-(R12+R22)| \quad (16)$$

$$\text{Delta}3=|(G12+G22)-(B12+B22)| \quad (17)$$

$$\text{Delta}R=|R11-R12+R21-R22| \quad (18)$$

$$\text{Delta}G=|G11-G12+G21-G22| \quad (19)$$

$$\text{Delta}B=|B11-B12+B21-B22| \quad (20)$$

$$\text{Delta}Th\leq(\text{Delta}1+\text{Delta}2+\text{Delta}3) \quad (21)$$

$$\text{Delta}ThCol\leq(\text{Delta}R+\text{Delta}G+\text{Delta}B) \quad (22)$$

in which R11, G11, and B11 represent pixel values of the red, green, and blue sub-pixels included in the pixel in the first row and first column, respectively; R12, G12, and B12 represent pixel values of the red, green, and blue sub-pixels included in the pixel in the first row and second column, respectively; R21, G21, and B21 represent pixel values of the red, green, and blue sub-pixels included in the pixel in the second row and first column, respectively; R22, G22, and B22 represent pixel values of the red, green, and blue sub-pixels included in the pixel in the second row and second column, respectively; K represents the number of pixels in the extending direction of the plurality of scanning signal lines; and DeltaTh and DeltaThCol each represent a threshold value specified in advance.

* * * * *